US009751723B2

(12) United States Patent
Yu et al.

(10) Patent No.: US 9,751,723 B2
(45) Date of Patent: Sep. 5, 2017

(54) BANKNOTE-SENDING TYPE BANKNOTE CONVEYING DEVICE

(71) Applicant: GRG BANKING EQUIPMENT CO., LTD., Guangzhou, Guangdong (CN)

(72) Inventors: Yong Yu, Guangdong (CN); Qiuhua Weng, Guangdong (CN); Dong Tan, Guangdong (CN)

(73) Assignee: GRG BANKING EQUIPMENT CO., LTD., Guanghou, Guangdong (CN)

( * ) Notice: Subject to any disclaimer, the term of this patent is extended or adjusted under 35 U.S.C. 154(b) by 0 days.

(21) Appl. No.: 15/325,211

(22) PCT Filed: Jul. 27, 2015

(86) PCT No.: PCT/CN2015/085183

§ 371 (c)(1),
(2) Date: Jan. 10, 2017

(87) PCT Pub. No.: WO2016/034024

PCT Pub. Date: Mar. 10, 2016

(65) Prior Publication Data

US 2017/0158458 A1 Jun. 8, 2017

(30) Foreign Application Priority Data

Sep. 4, 2014 (CN) ..... 2014 1 0449708

(51) Int. Cl.
*B65H 5/22* (2006.01)
*B65H 81/00* (2006.01)
(Continued)

(52) U.S. Cl.
CPC ..... *B65H 81/00* (2013.01); *G07D 11/0006* (2013.01); *B65H 31/06* (2013.01);
(Continued)

(58) Field of Classification Search
CPC ..... G07D 11/0012; G07D 11/0021; B65H 2701/1912; B65H 31/06; B65H 31/32
See application file for complete search history.

(56) References Cited

U.S. PATENT DOCUMENTS 5,813,825 A 9/1998 Arikawa et al.
5,897,114 A 4/1999 Arikawa et al.
(Continued)

FOREIGN PATENT DOCUMENTS

CN 1162159 A 10/1997
CN 1162802 A 10/1997
(Continued)

OTHER PUBLICATIONS

International Search Report for PCT/CN2015/085183, mailed Oct. 14, 2015, ISA/CN.

*Primary Examiner* — Howard Sanders
(74) *Attorney, Agent, or Firm* — U.S. Fairsky LLP; Yue Xu

(57) ABSTRACT

A banknote-passing type banknote conveying device, used at a banknote inlet-outlet of an automatic teller machine, includes a mounting lateral plate, a banknote stacking mechanism, a banknote clamping and conveying mechanism, a pressing mechanism, a jacking mechanism, and a central control unit for controlling the operation of the above mechanisms. The banknote-passing type banknote conveying device uses a lifting motor and a connection rod to drive a lifting plate to move the banknotes up and down, and uses a pressing plate to move the banknotes back and forth. The functions of stacking and passing banknotes are achieved in an effective space. Moreover, a pull type electromagnet and a spring are used to control the opening and closing of the banknote clamping and conveying mechanism, thus a traditional motor control method and the like can be omitted, such that the cost is low, and the reliability is high.

6 Claims, 8 Drawing Sheets

(51) Int. Cl.

| | |
|---|---|
| ***G07D 11/00*** | (2006.01) |
| *B65H 31/32* | (2006.01) |
| *B65H 31/06* | (2006.01) |

(52) U.S. Cl.
CPC ..... *B65H 31/32* (2013.01); *B65H 2701/1912* (2013.01); *G07D 11/0012* (2013.01); *G07D 11/0021* (2013.01)

(56) References Cited

U.S. PATENT DOCUMENTS

| | | | | |
|---|---|---|---|---|
| 6,276,678 | B1 | 8/2001 | Nottelmann et al. | |
| 7,677,545 | B2 * | 3/2010 | Iwami ..... | B65H 1/025 271/153 |
| 2003/0047601 | A1 | 3/2003 | Moniyama et al. | |
| 2015/0371480 | A1 | 12/2015 | Luo et al. | |

FOREIGN PATENT DOCUMENTS

| | | | |
|---|---|---|---|
| CN | 1403359 | A | 3/2003 |
| CN | 2589430 | Y | 12/2003 |
| CN | 202351951 | U | 7/2012 |
| CN | 102884553 | A | 1/2013 |
| CN | 103116938 | A | 5/2013 |
| CN | 103136853 | A | 6/2013 |
| CN | 103150810 | A | 6/2013 |
| CN | 103159091 | A | 6/2013 |
| CN | 103778708 | A | 5/2014 |
| CN | 103863878 | A | 6/2014 |
| CN | 104355191 | A | 2/2015 |
| JP | S60122637 | A | 7/1985 |
| JP | H10194607 | A | 7/1998 |

* cited by examiner

BANKNOTE-SENDING TYPE BANKNOTE CONVEYING DEVICE

This application is the national phase of International Application No. PCT/CN2015/085183, titled "BANKNOTE-SENDING TYPE BANKNOTE CONVEYING DEVICE", filed on Jul. 27, 2015 which claims the benefit of priority to Chinese patent application No. 201410449708.5 titled "BANKNOTE-PASSING TYPE BANKNOTE CONVEYING DEVICE", filed with the Chinese State Intellectual Property Office on Sep. 4, 2014, the entire disclosures of which applications are incorporated herein by reference.

FIELD

The present application relates to a banknote processing technology, and particularly relates to a banknote conveying device.

BACKGROUND

With the continuous development of economy, the load of banknote processing is increasing, and the requirement for processing capacity of banknote processing devices is improved accordingly. Banknote processing devices commonly used presently mainly include automatic banknote depositing and withdrawing machines, dispensers, and the like. In these devices, banknote receiving and outputting devices are widely used.

Currently banknote conveying mechanisms widely adopted by the banknote receiving and outputting devices have the defect of a complex structure, for example, a motor is employed to control the opening and closing of a clamping mechanism, and racks and gears are used for conveying the clamping mechanism, these mechanisms have complex structures, and failures such as mechanism locking are apt to occur.

SUMMARY

For addressing the issue in the conventional technology that the banknote conveying mechanism has a complex structure, a banknote-passing type banknote conveying device is provided according to the present application, which has a simple structure and is easy to control.

A banknote-passing type banknote conveying device according to the present application is applied in a banknote inlet-outlet of an automatic teller machine, the banknote-passing type banknote conveying device includes: a mounting side plate, a banknote stacking mechanism, a banknote clamping and conveying mechanism, a pressing mechanism, a jacking mechanism and a central control unit. The mounting side plate is configured to mount the following mechanisms and parts of the mechanisms. The banknote stacking mechanism includes an impeller wheel and a banknote stacking region, the banknote stacking region includes a lifting plate, a pressing plate, and a fixed plate, the lifting plate is located at a bottom of the banknote stacking region, and the pressing plate and the fixed plate constitute two opposite side walls of the banknote stacking region. The banknote clamping and conveying mechanism includes a drive motor and at least two sets of transmission wheels. A first set of transmission wheels is located at the banknote inlet-outlet, and a second set of transmission wheels is close to the banknote stacking region. A driving wheel of the first set of transmission wheels is connected to a driving wheel of the second set of transmission wheels by a driving wheel belt, and a driven wheel of the first set of transmission wheels is connected to a driven wheel of the second set of transmission wheels by a driven wheel belt. The driving wheel belt and the driven wheel belt form a banknote conveying passage, and a first pull type electromagnet and a first spring are arranged at a side away from the banknote conveying passage of the driven wheel of the first set of transmission wheels, and a second pull type electromagnet and a second spring are arranged at a side away from the banknote conveying passage of the driven wheel of the second set of transmission wheels. The pressing mechanism includes a stepper motor, a belt, and a pair of pulleys, the belt is connected to the pressing plate by a first sliding shaft to drive the pressing plate to move. The jacking mechanism includes a lifting motor, a first lifting connection rod, and a second lifting connection rod. One end of the first lifting connection rod is connected to one end of the lifting plate by a first sliding shaft for connection rod, and the second lifting connection rod is connected to another end of the lifting plate by a second sliding shaft for connection rod. The first sliding shaft for connection rod is located in an arc-shaped sliding slot in the mounting side plate, and the second sliding shaft for connection rod is located in a second arc-shaped sliding slot in the mounting side plate. When the lifting motor drives the first lifting connection rod and the second lifting connection rod to rotate, the first sliding shaft for connection rod and the second sliding shaft for connection rod slide respectively in the first arc-shaped sliding slot and the second arc-shaped sliding slot to drive the lifting plate to move up and down. The central control unit is configured to control operation of the above mechanisms.

Preferably, at least one set of transmission wheels is provided between the first set of transmission wheels and the second set of transmission wheels, the at least one set of transmission wheels includes a driving wheel and a driven wheel, the driving wheel is connected to the driving wheel of the first set of transmission wheels and the driving wheel of the second set of transmission wheels by the driving wheel belt, and the driven wheel is connected to the driven wheel of the first set of transmission wheels and the driven wheel of the second set of transmission wheels by the driven wheel belt, and a spring is provided at a side of the driven wheel, which side is away from the banknote conveying passage.

Preferably, the pressing plate is provided with a vertical guide slot, and the first sliding shaft is arranged in the vertical guide slot.

Preferably, the mounting side plate is provided with a horizontal guide slot, and the pressing plate is mounted in the horizontal guide slot by a second sliding shaft.

Optionally, the jacking mechanism includes a lifting driving wheel, and the lifting driving wheel is connected to the lifting motor by a belt, and the lifting driving wheel is connected to an end, away from the lifting plate, of the first lifting connection rod, to drive the first lifting connection rod to rotate.

Optionally, the jacking mechanism includes a first lifting driving wheel and a second lifting driving wheel, the first lifting driving wheel is connected to the lifting motor by a belt, and the first lifting driving wheel is connected to the second lifting driving wheel by another belt. The first lifting driving wheel is connected to an end of the first lifting connection rod, which end is away from the lifting plate, and the second lifting driving wheel is connected to an end of the second lifting connection rod, which end is away from the lifting plate.

Compared with the conventional technology, the banknote-passing type banknote conveying device according to the present application achieves the upward and downward movements of the banknotes by driving the lifting plate via the lifting motor and the connection rod, and achieves the forward and backward movement of the banknotes by the pressing plate, thus achieving the banknote stacking function and the banknote passing function in an effective space. And the banknote conveying device achieves clamping and conveying of the banknotes by the stepper motor and the synchronous belts, thus having higher transmission stability and a higher precision than a conventional gear-rack transmission. In addition, the closing and opening of the banknote clamping and conveying mechanism are controlled by the pull type electromagnets and the springs respectively, thereby omitting a conventional motor control method and the like, such that the cost is lower, and the reliability is higher.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

DETAILED DESCRIPTION

Technical solutions of embodiments of the present application will be clearly and completely described hereinafter in conjunction with the drawings of the embodiments according to the present application. Apparently, the embodiments described are only part embodiments of the present application, rather than all embodiments. Other embodiments obtained by those skilled in the art based on the embodiments of the present application without any creative efforts all fall into the scope of the present application.

Figure 1:
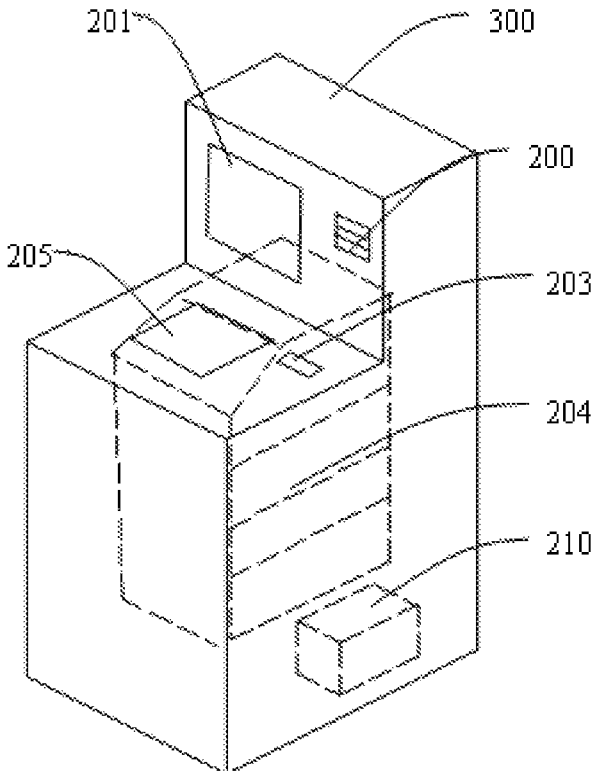
FIG. 1 is a schematic view showing the structure of an automatic banknote depositing and withdrawing machine adopting a banknote-passing type banknote conveying device according to an embodiment of the present application.

FIG. 1 is a perspective view showing an external appearance of a banknote depositing and withdrawing machine in which a banknote-passing type banknote conveying device according to an embodiment of the present application is applied. The automatic banknote depositing and withdrawing machine 300 includes: a display device 201, a card and detailed statement processing device 200, an input device 203, a banknote processing device 204, a banknote inlet-outlet 205, and a main control device 210. In addition, other various devices are also provided, illustrations and descriptions of which are omitted here.

Figure 2:
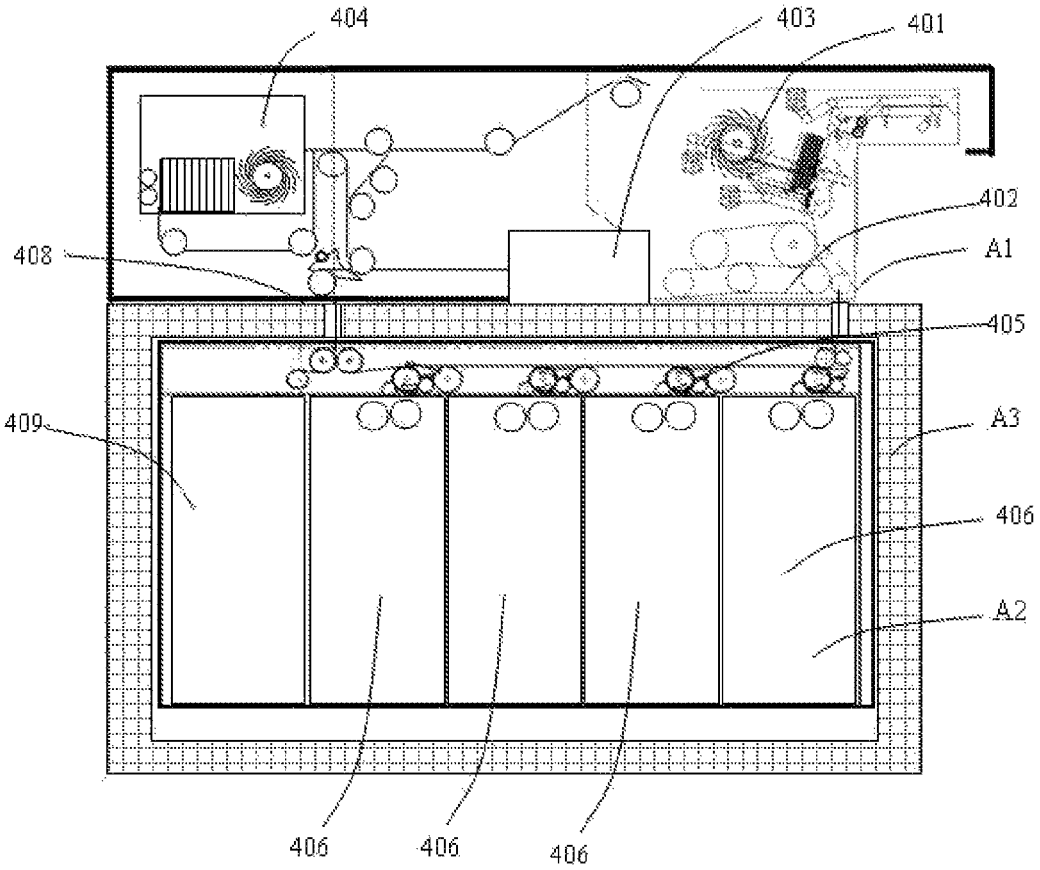
FIG. 2 is a view showing the structure of an internal core of the automatic banknote depositing and withdrawing machine in FIG. 1 which employs a banknote-passing type banknote conveying device.

FIG. 2 is a schematic view of the banknote processing device 204, i.e., an internal core of the automatic banknote depositing and withdrawing machine applying the banknote-passing type banknote conveying device according to this embodiment. The internal core of the automatic banknote depositing and withdrawing machine may be generally divided into an upper module A1, a lower module A2, and a vault A3. The lower module A2 is arranged in the vault A3. The upper module mainly includes a banknote separating device 401, a banknote conveying passage 402, a banknote identifier 403, and a temporary storage area 404. The lower module mainly includes a lower conveying passage 405, a depositing banknote cassette 409 and a cycling banknote cassette 406.

The banknote-passing type banknote conveying device according to this embodiment relates to the structure of the banknote separating device 401, which is described in detail by reference to FIG. 3.

Figure 3:
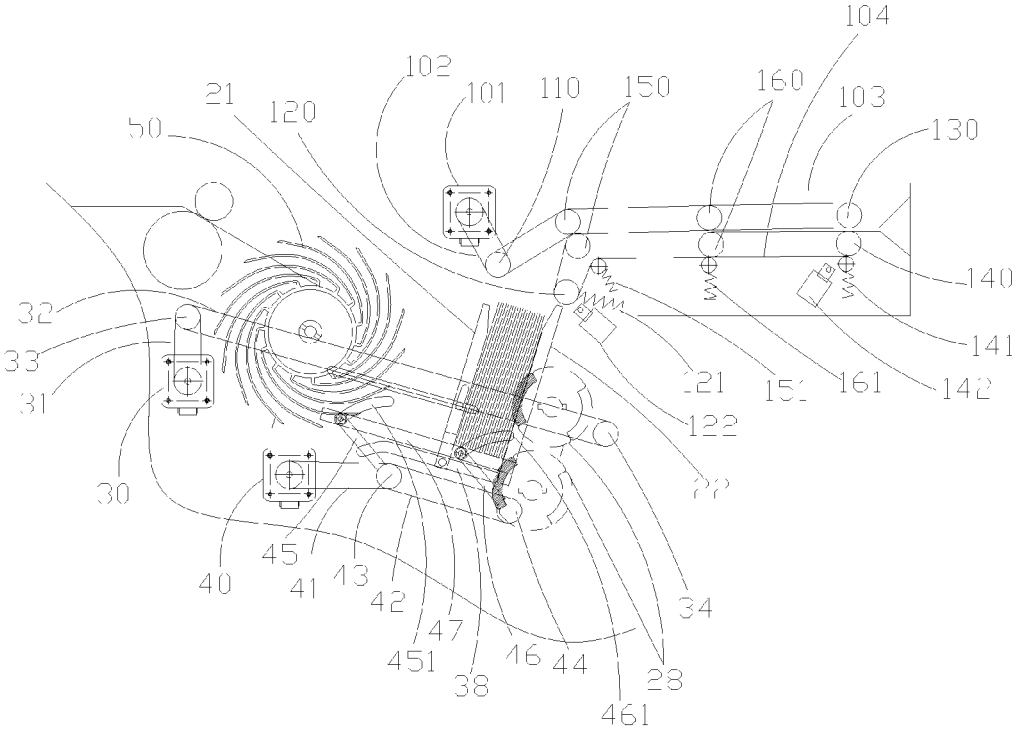
FIG. 3 is a view showing a detailed structure of the banknote-passing type banknote conveying device in FIG. 2.

As shown in FIG. 3, the banknote-passing type banknote conveying device is used at a banknote inlet-outlet of an automatic teller machine (the automatic depositing and withdrawing machine 300 in this embodiment), the banknote-passing type banknote conveying device includes a mounting side plate, a banknote stacking mechanism, a banknote clamping and conveying mechanism, a pressing mechanism, a jacking mechanism, and a central control unit configured to control operations of the above mechanisms.

The banknote stacking mechanism includes an impeller wheel 50 and a banknote stacking region. The banknote stacking region includes a lifting plate 47, a pressing plate 21 and a fixed plate 22. The lifting plate 47 is located at the bottom of the banknote stacking region, and the pressing plate 21 and the fixed plate 22 form two side walls of the banknote stacking region which are opposite.

The banknote clamping and conveying mechanism includes a drive motor 101 and at least two sets of transmission wheels, i.e., a first set of transmission wheels and a second set of transmission wheels. The first set of transmission wheels is located at the banknote inlet-outlet, and includes a driving wheel 130 and a driven wheel 140. The second set of transmission wheels is close to the banknote stacking region, and includes a driving wheel 110 and a driven wheel 120. The driving wheel 130 and the driving wheel 110 are connected by a driving wheel belt 103, and the driven wheel 140 and the driven wheel 120 are connected by a driven wheel belt 104. The driving wheel belt 103 and the driven wheel belt 104 form a banknote conveying passage. A first pull type electromagnet 142 and a first spring 141 are arranged at a side away from the banknote conveying passage, of the driven wheel 140 of the first set of transmission wheels, and a second pull type electromagnet 122 and a second spring 121 are arranged at a side away from the banknote conveying passage of the driven wheel 120 of the second set of transmission wheels. In an energized state, the pull type electromagnet is stretched to pull the spring, so that the driving wheel and the driven wheel are closely joined, thus achieving the purpose of clamping banknotes. In a de-energized state, the pull type electromagnet releases the spring, and the spring pulls back the driven wheel under the action of a contracting force, such that the driven wheel is pulled to keep a certain distance from the driving wheel, thus functioning to open the clamping mechanism. Preferably, at least one set of transmission wheels is provided between the first set of transmission wheels and the second set of transmission wheels. As shown in FIG. 3, in this embodiment, two sets of transmission wheels 150 and 160 are provided between the first set of transmission wheels and the second set of transmission wheels. Each of the two sets of transmission wheels includes a driving wheel and a driven wheel, the driving wheel is connected to the driving wheel 130 of the first set of transmission wheels and the driving wheel 110 of the second set of transmission wheels by the driving wheel belt 103, and the driven wheel is connected to the driven wheel 140 of the first set of transmission wheels and the driven wheel 120 of the second set of transmission wheels by the driven wheel belt 104, and springs 151 and 161 are provided at a side away from the banknote conveying passage of the driven wheels respectively. The sets of transmission wheels arranged in the middle can strengthen a conveying power of the banknote clamping and conveying device, and the springs 151 and 161 at the side away from the banknote conveying passage of the driven wheels of the sets of transmission wheels can have the effect of clamping the banknotes tightly. And when a thick stack of banknote passes through the banknote clamping and conveying mechanism, the springs are compressed, which allows the stack of banknotes to pass through.

Figure 4:
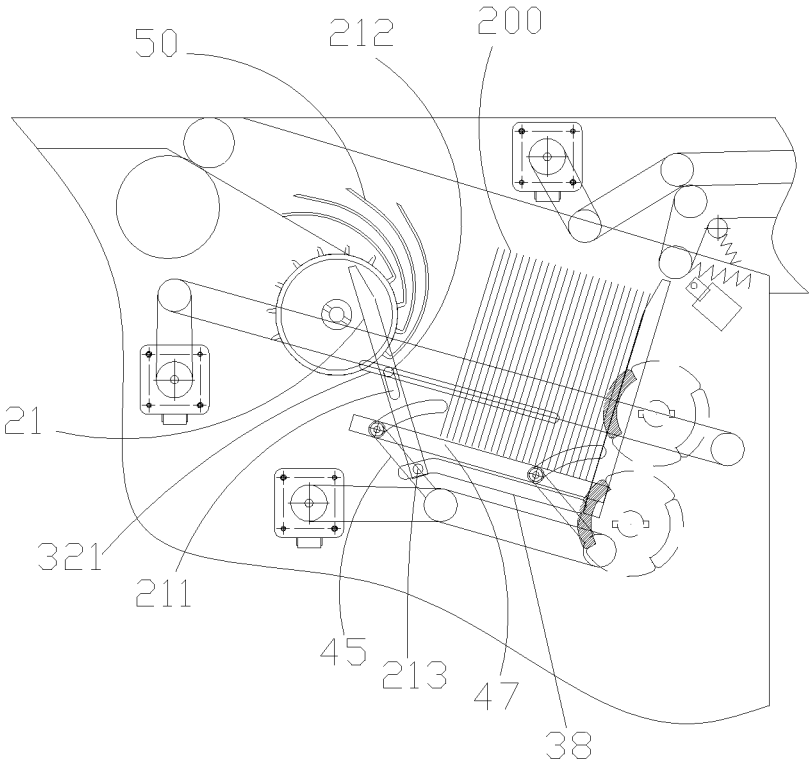
FIG. 4 is a view of a local structure of the banknote-passing type banknote conveying device, which shows a state in which banknotes enter a banknote stacking region during banknote outputting process.

Referring to FIG. 4, the pressing mechanism includes a stepper motor 30, a belt 32 and a pair of pulleys 33 and 34. The stepper motor 30 is connected to the pulley 33 by a belt 31, and the belt 32 is connected to the pressing plate 21 by a first sliding shaft 212 for driving the pressing plate to move. Specifically, the pressing plate is provided with a vertical guide slot 211, and the first sliding shaft 212 is arranged in the vertical guide slot 211. The mounting side plate is provided with a horizontal guide slot 38, and the pressing plate 21 is mounted in the horizontal guide slot 38 by a second sliding shaft 213. In this way, the pressing plate 21 may be moved horizontally along with the belt 32, and due to the arrangement of the vertical guide slot 211, the pressing plate, when moved leftwards, may be opened by a certain angle for accommodating the banknotes conveyed by the impeller wheel 50, as shown in FIG. 4.

The jacking mechanism includes a lifting motor 40, a first lifting connection rod 45 and a second lifting connection rod 46. The first lifting connection rod 45 has one end connected to one end of the lifting plate 47 by a first sliding shaft for connection rod, and the second lifting connection rod 46 is connected to another end of the lifting plate 47 by a second sliding shaft for connection rod. The first sliding shaft for connection rod is located in an arc-shaped sliding slot 451 in the mounting side plate, and the second sliding shaft for connection rod is located in a second arc-shaped sliding slot 461 in the mounting side plate. When the lifting motor 40 drives the first lifting connection rod 45 and the second lifting connection rod 46 to rotate, the first sliding shaft for connection rod and the second sliding shaft for connection rod slide in the first arc-shaped sliding slot 451 and the second arc-shaped sliding slot 461 respectively, thus driving the lifting plate 47 to move up and down.

The lifting motor 40 may drive the first lifting connection rod 45 and the second lifting connection rod 46 by two methods. One method is to drive by double driving wheels, i.e., the method employed in this embodiment as shown in FIG. 3, the lifting motor 40 is connected to a first lifting driving wheel 43 by a belt 41, and the first lifting driving wheel 43 is connected to a second lifting driving wheel 44 by another belt 42. The first lifting driving wheel 43 is connected to one end of the first lifting connection rod 45, which end is away from the lifting plate 47; and the second lifting driving wheel 44 is connected to one end of the second lifting connection rod 46, which end is away from the lifting plate 47. In this way, the lifting motor 40 drives the first lifting driving wheel 43 and the second lifting driving wheel 44 to rotate, and the first lifting driving wheel 43 drives the end of the first lifting connection rod 45, which end is away from the lifting plate 47, to rotate; and an end of the first lifting connection rod 45, which end is connected to the lifting plate 47, that is, the first sliding shaft for connection rod, slides in the first arc-shaped sliding slot 451 under the action of the driving force. Similarly, the second sliding shaft for connection rod slides in the second arc-shaped sliding slot 461, thus driving the lifting plate 47 to move up and down to achieve the function of lifting and lowering of the lifting plate 47, thereby achieving the function of jacking the banknotes out. Another feasible driving method is to drive by a single driving wheel, i.e., the second lifting driving wheel 44 and the belt 42 are omitted. The end of the second lifting connection rod 46, which end is away from the lifting plate 47, is movably connected to the mounting side plate, and the first lifting connection rod 45 is driven by the first lifting driving wheel 43, thus driving the lifting plate 47 and the second lifting connection rod 46 to move, which can also achieve the lifting and lowering movements of the lifting plate 47.

The process for the banknote-passing type banknote conveying device to convey banknotes during banknote depositing and withdrawing processes are described in detail hereinafter in combination with FIGS. 3 to 8.

In the banknote withdrawing process, the banknotes are outputted by the impeller wheel 50, and are stacked in a banknote stacking region formed by the lifting plate 47, the fixed plate 22 and the pressing plate 21. As shown in FIG. 3 and FIG. 4, in the banknote stacking process, the second sliding shaft 213 for the pressing plate 21 slides to a leftmost end of the horizontal guide slot 38, and the first sliding shaft 212 slides to an uppermost end of the vertical guide slot 211 and is drawn by the belt 32 to a left side. Therefore, the pressing plate is not only close to the left side, but also inclined leftward at a certain angle, thus having a guiding function, which allows the banknotes 200 outputted by rotation of the impeller wheel 50 to be orderly guided into the banknote stacking region. The banknotes fall onto the lifting plate 47 by the rotation of the impeller wheel 50, and after the number of the banknotes outputted reaches a predetermined requirement, the impeller wheel 50 stops rotating, and the device enters a banknote tightly pressed stage.

Figure 5:
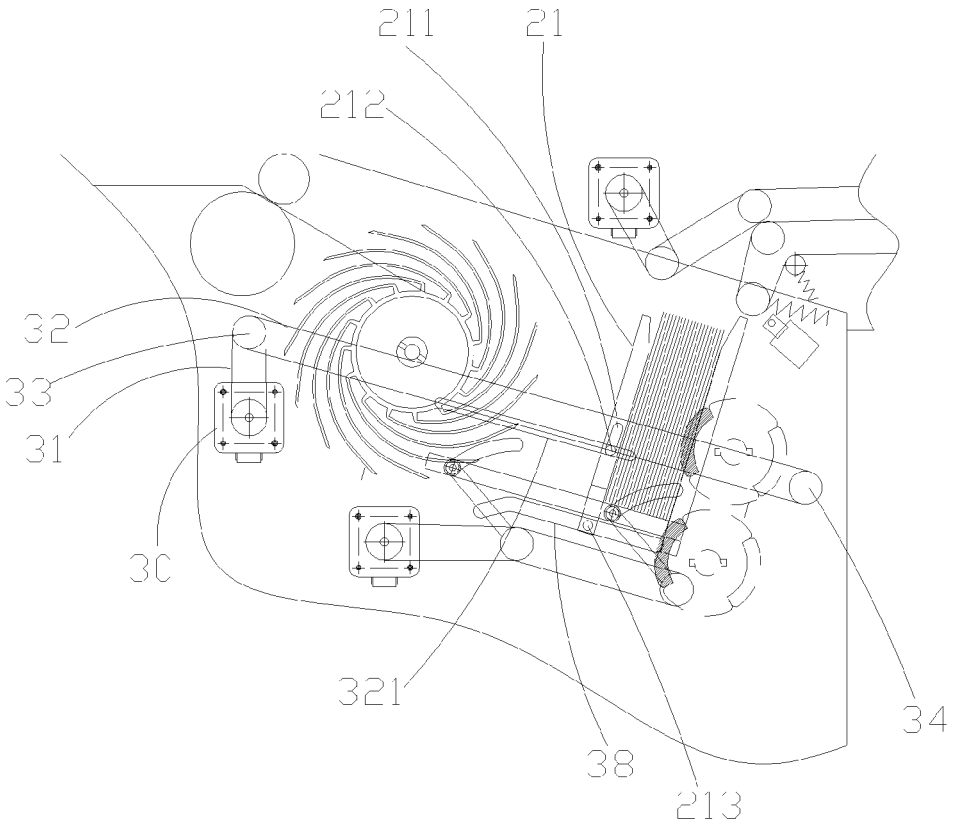
FIG. 5 is a view showing a state in which banknotes are pressed by a pressing mechanism in the banknote stacking region.
Figure 6:
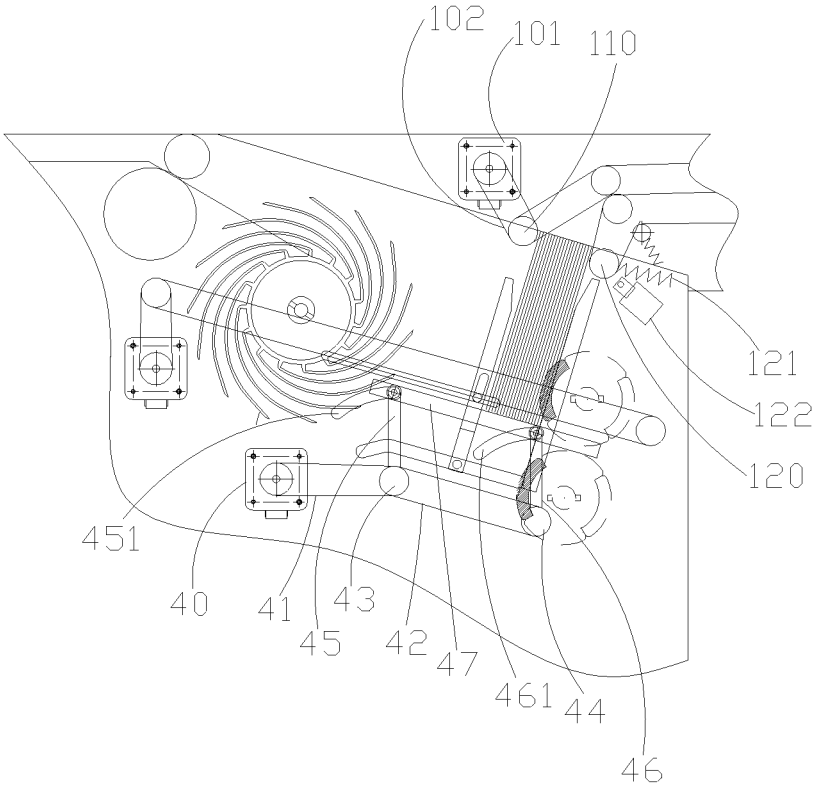
FIG. 6 is a view showing a state in which banknotes are jacked up by a jacking mechanism.

As shown in FIGS. 3 and 5, the stepper motor 30 is started and the pulley 33 is driven to rotate by the stepper motor 30, the pulley 33 drives the first sliding shaft 212 in the pressing plate 21 via the belt 32 to move rightwards, meanwhile the second guide shaft 213 at a lower portion of the pressing plate 21 moves rightwards in the horizontal guide slot in the mounting side plate, thus pressing the banknotes 200 towards the fixed plate 22 tightly.

The banknotes 200 are jacked out by the jacking mechanism after being pressed. As shown in FIGS. 3 to 6, the lifting motor 40 is started, and the first lifting driving wheel 43 and the second lifting driving wheel 44 are driven, by the lifting motor 40, to rotate together via the belt 41 and the belt 42. The first lifting driving wheel 43 drives the first lifting connection rod 45 to rotate from left to right, and the second lifting driving wheel 44 drives the second lifting connection rod 46 to rotate from left to right. The first lifting connection rod 45 is connected to one end of the lifting plate 47 by the first sliding shaft for connection rod, and the second lifting connection rod 46 is connected to another end of the lifting plate 47 by the second sliding shaft for connection rod, and moreover the first sliding shaft for connection rod is arranged in the first arc-shaped sliding slot 451, and the second sliding shaft for connection rod is arranged in the second arc-shaped sliding slot 461, therefore when the first lifting connection rod 45 and the second lifting connection rod 46 are driven to rotate from left to right, the first sliding shaft for connection rod and the second sliding shaft for connection rod slide from left to right in the first arc-shaped sliding slot and the second arc-shaped sliding slot respectively, thus the lifting plate 47 is lifted, and the movement of the lifting plate 47 being jacked out from downward to upward is achieved. When the first sliding shaft for connection rod reaches the rightmost end of the first arc-shaped sliding slot as well as the second sliding shaft for connection rod reaches the second arc-shaped sliding slot, the lifting plate 47 is lifted to a highest position, and thus the banknotes are jacked out towards upper ends of the pressing plate 21 and the fixed plate 22, that is, the banknotes are jacked upwards to be close to the second set of transmission wheels of the banknote clamping and conveying device. At this time, the second set of transmission wheels is in an opened state, that is, the second pull type electromagnet 122 is energized, and thus the second spring 121 is compressed to pull the driven wheel 120 to form a certain angle with respect to the driving wheel 110, thereby the banknotes 200 are easy to enter between the driving wheel 110 and the driven wheel 120.

Figure 7:
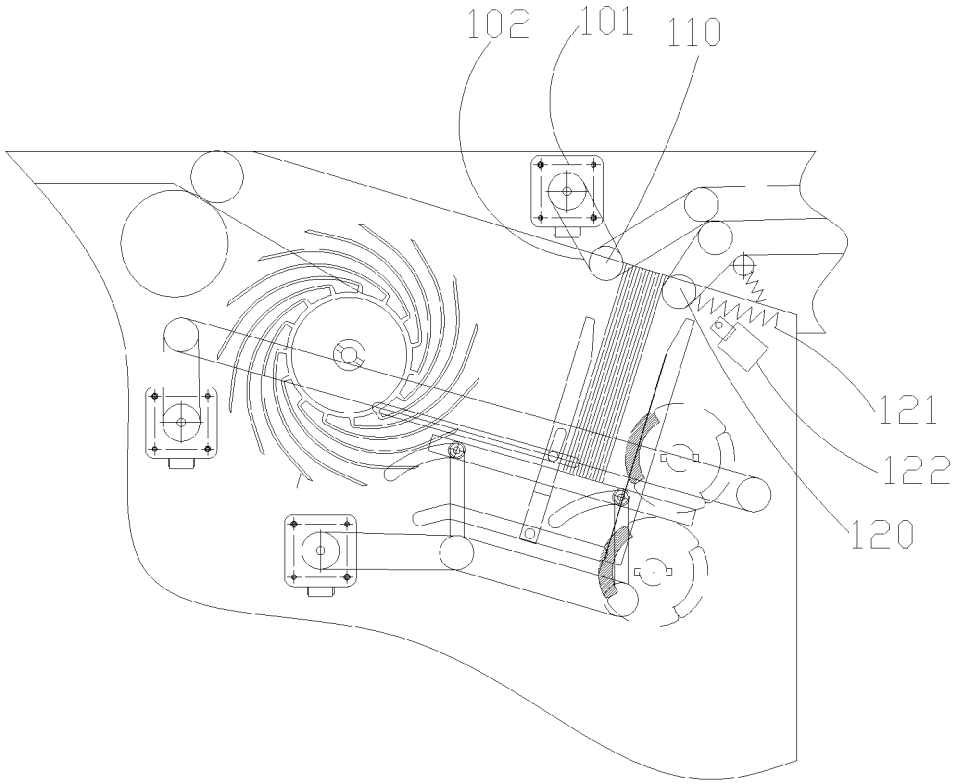
FIG. 7 is a view showing a state in which banknotes are clamped by a banknote clamping and conveying mechanism.
Figure 8:
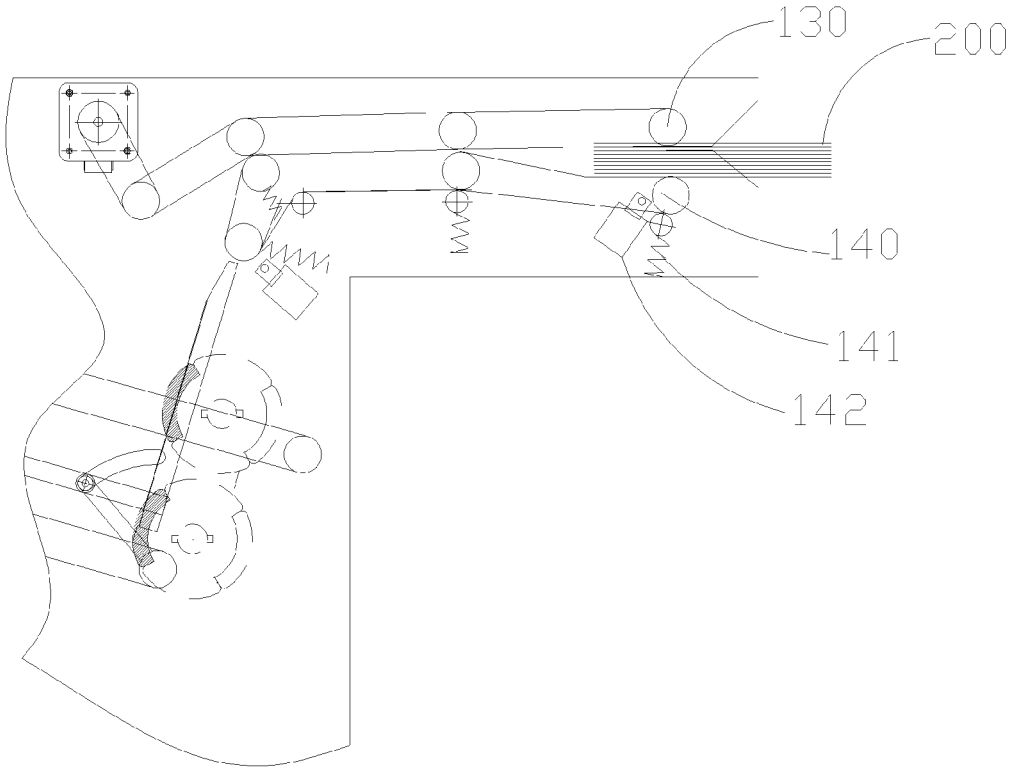
FIG. 8 is a schematic view showing a state in which banknotes are clamped by the banknote clamping and conveying mechanism during banknote feeding process.

As shown in FIGS. 3 to 7, after the banknotes are jacked up by the lifting plate 47, the pull type electromagnet 122 controls to release the driven wheel 120, and the driven wheel 120 tightly presses and clamps the banknotes 200 towards the driving wheel 110 under the action of the spring 121. After the banknotes 200 are clamped, the driving wheel 110 is driven to rotate by the drive motor 101 of the banknote clamping and conveying mechanism via the belt 102, and then the banknotes 200 are clamped by the driving wheel belt 103 and the driven wheel belt 104 to enter the conveying passage. When the banknotes 200 are conveyed in the conveying passage, the drive motor 101 drives the driving wheel 110 via the belt 102 to rotate. In the upper passage, the driving wheel 110 drives the driving wheel 130 of the first set of transmission wheels and the driving wheels of the sets of transmission wheels 150, 160 via the belt 103 to rotate. In the lower passage, the driven wheel belt 104 drives the driven wheels 120, 140 and the driven wheels of the sets of transmission wheels 150, 160 to rotate. When the banknotes 200 pass through each set of transmission wheels, the driven wheels press the springs 151 and 161 respectively via the thickness of the banknotes. After the banknotes pass, the springs 151 and 161 reset automatically, thus may meet the requirement for whole stacks of banknotes of various thicknesses to pass through, and finally the banknotes are outputted to a position as shown in FIG. 8 for the customer to withdraw. Thus the banknote-passing type banknote conveying device finishes the process in which the banknotes are conveyed from the banknote stacking region to the banknote inlet-outlet during banknote withdrawing process.

When a customer deposits banknotes, and the device needs to input banknotes, as shown in FIG. 8, the first pull type electromagnet 142 controls the driven wheel 140 to be tightly pulled downwards, meanwhile, the first spring 141 is in a tightly pressed state, and the first set of transmission wheels is in an opened state. After the banknotes 200 are placed, the first pull type electromagnet 142 is released, the first spring 141 bounces the driven wheel 140 upwards to press the banknotes 200 between the driven wheel 140 and the driving wheel 130, and then the driving wheel belt 103 and the driven wheel belt 104 are driven by the drive motor 101 to rotate together to convey the banknotes into the banknote stacking region as shown in FIG. 7. At this time, the second pull type electromagnet 122 is energized, and thus the second spring is compressed, and lower ends of the banknotes 200 are received by the pressing plate 21 and the fixed plate 22 and the banknotes 200 are placed on the lifting plate 47. And then the lifting motor 40 drives the first lifting driving wheel 43 and the second lifting driving wheel 44 via the belt 41 and the belt 42 respectively to rotate reversely. The first lifting driving wheel 43 drives the first lifting connection rod 45 to rotate from right to left, and the second lifting driving wheel 44 drives the second lifting connection rod 46 to rotate from right to left, thus, the first sliding shaft for connection rod and the second sliding shaft for connection rod slide along the first arc-shaped sliding slot 451 and the second arc-shaped sliding slot 461 from right to left respectively, therefore, the lifting plate 47 is lowered, thereby achieving the movement of the lifting plate 47 from up to down. When the first sliding shaft for connection rod the leftmost end of the first arc-shaped sliding slot 451, and the second sliding shaft for connection rod reaches the leftmost end of the second arc-shaped sliding slot 461 respectively, the lifting plate 47 is lowered to a lowermost position, as shown in FIG. 5. In this way, the lifting plate 47 realizes the up and down movements by the right and left swings of the first lifting connection rod 45 and the second lifting connection rod 46. Thus, the banknote-passing type banknote conveying device finishes the process of conveying the banknotes from the banknote inlet-outlet to the banknote stacking region during banknote depositing process.

When the lifting plate 47 is lowered to a position shown in FIG. 5, and then the banknote separating wheel 28 draws the banknotes one by one into the lower conveying passage 405 inside the machine core. When the banknotes are drawn-in completely, the pressing plate 21 is driven by the stepper motor 30 via the belt 32 to rotate from right to left to reach a position in FIG. 4, and the above actions in FIGS. 4 to 8 are started to be repeated to enter a next cycle.

Compared with the conventional technology, the banknote-passing type banknote conveying device according to this embodiment achieves the upward and downward movements of the banknotes by driving the lifting plate 47 via the lifting motor 40 and the first lifting connection rod 45 and the second lifting connection rod 46, and achieves the forward and backward movements of the banknotes by the pressing plate 21, thus achieving the banknote stacking function and the banknote passing function in an effective space, and the banknote-passing type banknote conveying device achieves clamping and conveying of the banknotes by the stepper motor 101 and the synchronous belts 103 and 104, thereby having a higher transmission stability and a higher precision than a gear-rack transmission. In addition, the closing and opening of the banknote clamping and conveying mechanism are controlled by the pull type electromagnets 122, 142 and the springs 141, 121 respectively, thereby omitting a conventional motor control method and the like, such that the cost is lower, and the reliability is higher.

The above embodiments are only preferable embodiments of the present application and are not intended to limit the scope of the present application. Any equivalent variations made based on the specification and drawings of the present application should be deemed to fall into the scope of the present application.

The invention claimed is:

1. A banknote-passing type banknote conveying device, used at a banknote inlet-outlet of an automatic teller machine, the banknote-passing type banknote conveying device comprises:

a mounting side plate configured to mount a banknote stacking mechanism, a banknote clamping and conveying mechanism, a pressing mechanism and a jacking mechanism;

the banknote stacking mechanism, comprising an impeller wheel and a banknote stacking region, wherein the banknote stacking region comprises a lifting plate, a pressing plate and a fixed plate, the lifting plate is located at a bottom of the banknote stacking region, and the pressing plate and the fixed plate constitute two opposite side walls of the banknote stacking region;

the banknote clamping and conveying mechanism, comprising a drive motor and at least two sets of transmission wheels in which a first set of transmission wheels is located at the banknote inlet-outlet and a second set of transmission wheels is close to the banknote stacking region, wherein:

a driving wheel of the first set of transmission wheels is connected to a driving wheel of the second set of transmission wheels by a driving wheel belt, a driven wheel of the first set of transmission wheels is connected to a driven wheel of the second set of transmission wheels by a driven wheel belt, the driving wheel belt and the driven wheel belt form a banknote conveying passage, a first pull type electromagnet and a first spring are arranged at a side away from the banknote conveying passage, of the driven wheel of the first set of transmission wheels, and a second pull type electromagnet and a second spring are arranged at a side away from the banknote conveying passage, of the driven wheel of the second set of transmission wheels;

the pressing mechanism, comprising a stepper motor, a belt and a pair of pulleys, the belt being connected to the pressing plate by a first sliding shaft to drive the pressing plate to move;

the jacking mechanism, comprising a lifting motor, a first lifting connection rod and a second lifting connection rod, wherein:

one end of the first lifting connection rod is connected to one end of the lifting plate by a first sliding shaft for connection rod, the second lifting connection rod is connected to another end of the lifting plate by a second sliding shaft for connection rod, the first sliding shaft for connection rod is located in a first arc-shaped sliding slot in the mounting side plate, and the second sliding shaft for connection rod is located in a second arc-shaped sliding slot in the mounting side plate, when the lifting motor drives the first lifting connection rod and the second lifting connection rod to rotate, the first sliding shaft for connection rod and the second sliding shaft for connection rod slide respectively in the first arc-shaped sliding slot and the second arc-shaped sliding slot to drive the lifting plate to move up and down; and a central control unit configured to control operation of the above mechanisms.

2. The banknote-passing type banknote conveying device according to claim 1, wherein, at least one set of transmission wheels is provided between the first set of transmission wheels and the second set of transmission wheels, the at least one set of transmission wheels comprises a driving wheel and a driven wheel;

the driving wheel is connected to the driving wheel of the first set of transmission wheels and the driving wheel of the second set of transmission wheels by the driving wheel belt;

the driven wheel is connected to the driven wheel of the first set of transmission wheels and the driven wheel of the second set of transmission wheels by the driven wheel belt; and a spring is provided at a side of the driven wheel, which side is away from the banknote conveying passage.

3. The banknote-passing type banknote conveying device according to claim 1, wherein the pressing plate is provided with a vertical guide slot, and the first sliding shaft is arranged in the vertical guide slot.

4. The banknote-passing type banknote conveying device according to claim 1, wherein the mounting side plate is provided with a horizontal guide slot, and the pressing plate is mounted in the horizontal guide slot by a second sliding shaft.

5. The banknote-passing type banknote conveying device according to claim 1, wherein the jacking mechanism comprises a lifting driving wheel, and the lifting driving wheel is connected to the lifting motor by a belt, and the lifting driving wheel is connected to an end of the first lifting connection rod, which end is away from the lifting plate, to drive the first lifting connection rod to rotate.

6. The banknote-passing type banknote conveying device according to claim 1, wherein the jacking mechanism comprises a first lifting driving wheel and a second lifting driving wheel, the first lifting driving wheel is connected to the lifting motor by a belt, and the first lifting driving wheel is connected to the second lifting driving wheel by another belt; and the first lifting driving wheel is connected to an end of the first lifting connection rod, which end is away from the lifting plate, and the second lifting driving wheel is connected to an end of the second lifting connection rod, which end is away from the lifting plate.

* * * * *